US006793804B1

(12) United States Patent
Lindsay et al.

(10) Patent No.: US 6,793,804 B1
(45) Date of Patent: Sep. 21, 2004

(54) INTEGRATED HYDROTREATING PROCESS FOR THE DUAL PRODUCTION OF FCC TREATED FEED AND AN ULTRA LOW SULFUR DIESEL STREAM

(75) Inventors: David A. Lindsay, Prairie View, IL (US); Gary R. Brierley, Crystal Lake, IL (US); Tom N. Kalnes, LaGrange, IL (US)

(73) Assignee: UOP LLC, Des Plaines, IL (US)

( * ) Notice: Subject to any disclaimer, the term of this patent is extended or adjusted under 35 U.S.C. 154(b) by 483 days.

(21) Appl. No.: 10/045,265

(22) Filed: Nov. 7, 2001

(51) Int. Cl.[7] ..... C10G 45/02; C10G 65/04; C10G 65/16

(52) U.S. Cl. ..... 208/210; 208/211; 208/212; 208/89

(58) Field of Search ..... 208/210, 211, 208/212, 89

(56) References Cited

U.S. PATENT DOCUMENTS 3,306,845 A * 2/1967 Poll ..... 208/254 H
3,540,999 A 11/1970 Jacobs ..... 208/59
4,399,026 A * 8/1983 Shiroto et al. ..... 208/216 PP
5,114,562 A 5/1992 Haun et al. ..... 208/89
6,635,170 B2 * 10/2003 Ravella ..... 208/210
6,638,418 B1 * 10/2003 Kalnes et al. ..... 208/89

* cited by examiner

*Primary Examiner*—Walter D. Griffin
(74) *Attorney, Agent, or Firm*—John G. Tolomei; John G. Cutts

(57) ABSTRACT

An integrated hydrotreating process which produces a high quality feed for the FCC to maintain sulfur in FCC gasoline to a level lower than 30 ppm from a high boiling feedstock and an ultra low sulfur diesel stream preferably less than 10 ppm from a cracked diesel boiling material. The high boiling feedstock is firstly hydrotreated to reduce the concentration of heterogeneous compounds which produces lower boiling hydrocarbonaceous compounds boiling in the diesel range and the resulting hydrotreated high boiling feedstock is separated in a high pressure stripper. The resulting hydrocarbonaceous compounds boiling in the diesel range together with other cracked and/or straight run material in the diesel boiling range are further hydrotreated in an integrated second hydrotreating zone to meet ultra low sulfur diesel specifications and a high cetane index.

10 Claims, 1 Drawing Sheet

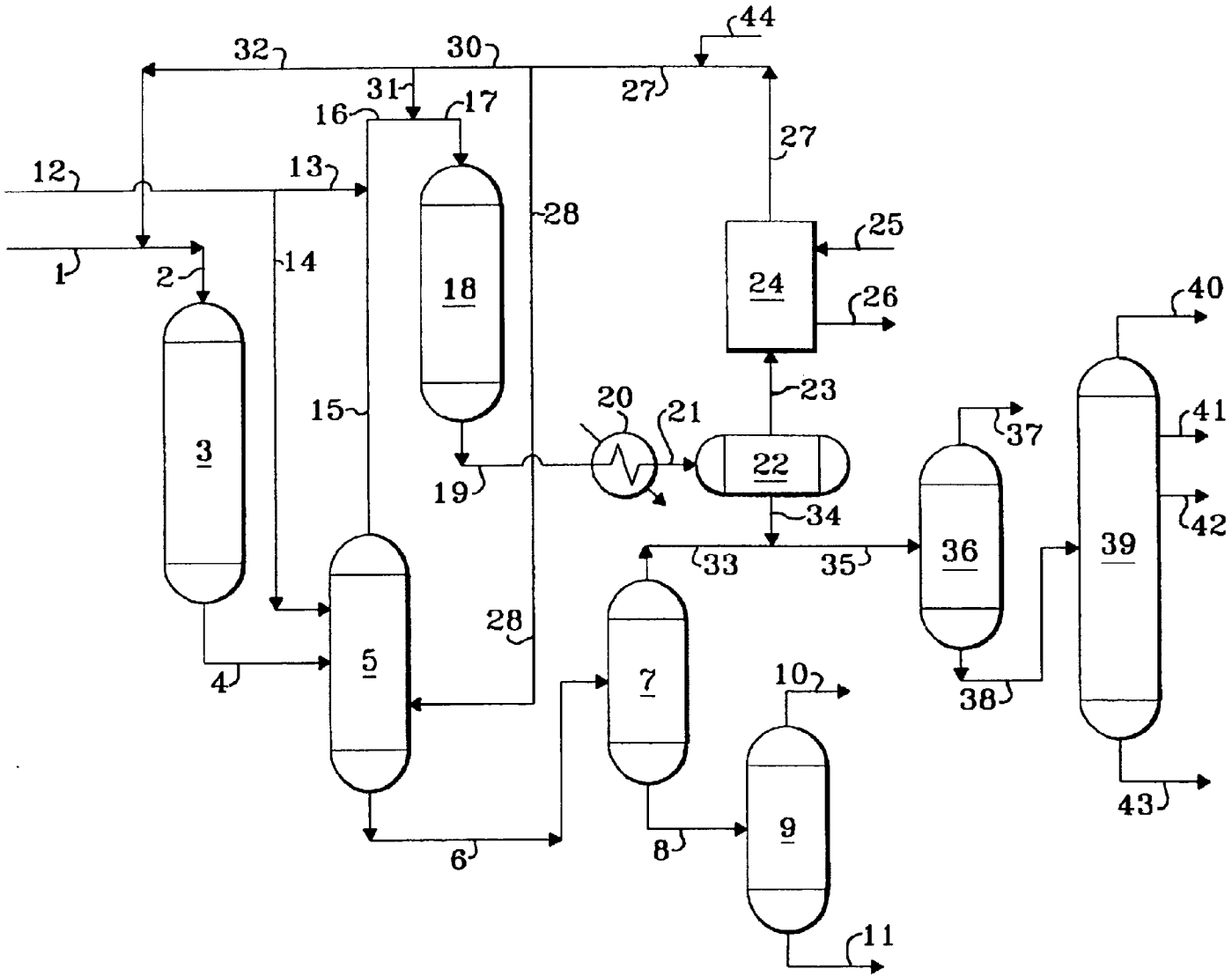
1
2
3
4
5
6
7
8
9
10
11
12
13
14
15
16
17
18
19
20
21
22
23
24
25
26
27
28
30
31
32
33
34
35
36
37
38
39
40
41
42
43
44

INTEGRATED HYDROTREATING PROCESS FOR THE DUAL PRODUCTION OF FCC TREATED FEED AND AN ULTRA LOW SULFUR DIESEL STREAM

BACKGROUND OF THE INVENTION

The field of art to which this invention pertains is the preparation and treating of a fluid catalytic cracking (FCC) feed and the production of an ultra low sulfur diesel stream with high quality and high cetane index from a hydrocarbonaceous feedstock of straight run and/or cracked stock origin. Hydrotreating processes have been used by petroleum refiners to produce more valuable hydrocarbonaceous streams such as naphtha, gasoline, kerosene and diesel, for example, having lower concentrations of sulfur and nitrogen. Feedstocks most often subjected to hydrotreating are normally liquid hydrocarbonaceous streams such as naphtha, kerosene, diesel, gas oil, vacuum gas oil (VGO), and reduced crude, for example. Traditionally, the hydrotreating severity is selected to produce an improvement sufficient to produce a marketable product. Over the years, it has been recognized that due to environmental concerns and newly enacted rules and regulations, saleable products must meet lower and lower limits on contaminants such as sulfur and nitrogen. Recently new regulations are being proposed in the United States and Europe which basically require the complete removal of sulfur from liquid hydrocarbons which are used as transportation fuels such as gasoline and diesel.

Hydrotreating is generally accomplished by contacting the hydrocarbonaceous feedstock in a hydrotreating reaction vessel or zone with a suitable hydrotreating catalyst under conditions of elevated temperature and pressure in the presence of hydrogen to yield a product containing desired maximum limits of sulfur. The operating conditions and the hydrotreating catalysts within the hydrotreating reactor influence the quality of the hydrotreated products.

Although a wide variety of process flow schemes, operating conditions and catalysts have been used in commercial hydrotreating activities, there is always a demand for new hydrotreating methods which provide lower costs and required product quality and specifications. With the mandated low sulfur transportation fuels, the process of the present invention greatly improves the plot space requirements and the economic benefits of simultaneously producing hydrotreated cracking feedstocks and low sulfur diesel stocks in one unit. The hydrotreated cracking feedstock will allow the production of low sulfur gasoline to be produced from a downstream FCC unit.

INFORMATION DISCLOSURE

U.S. Pat. No. 3,540,999 (Jacobs) discloses a process for converting heavier hydrocarbonaceous material into jet fuel kerosene and gasoline fractions. The simultaneous production of both jet fuel and gasoline fractions, in maximum quantities, is afforded through the utilization of a modified "series-flow" system. A two-stage process in which the jet fuel kerosene fraction is produced in the first stage with the gasoline fraction being produced in the second stage.

U.S. Pat. No. 5,114,562 (Haun et al) discloses a process wherein middle distillate petroleum streams are hydrotreated to produce a low sulfur and low aromatic product in two reaction zones in series. The effluent of the first reaction zone is purged of hydrogen sulfide by hydrogen stripping and then reheated by indirect heat exchange. The second reaction zone employs a sulfur-sensitive noble metal hydrogenation catalyst.

BRIEF SUMMARY OF THE INVENTION

The present invention is an integrated hydrotreating process which combines two very different functions in one unit: (1) treating VGO boiling range material to prepare feed for the FCC and (2) treating low quality straight run or cracked diesel boiling range material to produce an ultra low sulfur diesel stream of high quality and high cetane index. A high boiling VGO feedstock is firstly hydrotreated to reduce the concentration of sulfur such that further cracking of the VGO material in the FCC unit will produce gasoline which would meet low sulfur specifications. The first hydrotreating zone is required to operate at a severity sufficient to reduce the sulfur content of gasoline which is subsequently produced. The resulting hydrocarbonaceous compounds boiling in the diesel range produced from the severe treating of the VGO material must be further hydrotreated to meet the new ultra low sulfur diesel specifications (<10 PPM). The effluent from the first hydrotreating zone is introduced into a high pressure stripper preferably maintained at a temperature from about 149° to 454° C. (300° to 850° F.) to produce a gaseous hydrocarbonaceous stream comprising hydrogen and diesel boiling range hydrocarbons, and a liquid stream comprising hydrocarbons boiling above the diesel boiling range. A second hydrotreating zone is utilized to desulferize the previously vaporized diesel range hydrocarbons produced in the stripper which is economically achieved by the integration of the second hydrotreating zone with the first hydrotreating zone. Feed to the second hydrotreating zone will preferably include cracked and/or straight run diesel from various external sources and diesel produced in the first hydrotreating zone.

In accordance with one embodiment, the present invention relates to an integrated hydrotreating process for the production of a low sulfur diesel stream which process comprises: (a) passing a first hydrocarbonaceous feedstock and hydrogen to a first denitrification and desulfurization reaction zone operated at reaction zone conditions including a temperature from about 204° to 482° C. (400° to 900° F.) and a pressure from about 3.6 to 17.3 MPa (500 to 2500 psig) with a catalyst and recovering a denitrification and desulfurization reaction zone effluent therefrom; (b) passing the denitrification and desulfurization reaction zone effluent to a high pressure stripper maintained at a temperature from about 149° to 454° C. (300° to 850° F.) to produce a first vapor stream and a first liquid stream; (c) passing at least a portion of the first vapor stream and a second feedstock comprising diesel boiling range hydrocarbons to a second denitrification and desulfurization reaction zone to produce a second liquid stream comprising reduced sulfur content, diesel boiling range hydrocarbons and a hydrogen-rich gaseous stream containing hydrogen sulfide; (d) passing the hydrogen-rich gaseous stream containing hydrogen sulfide to an acid gas scrubbing zone to produce a hydrogen-rich gaseous stream having a reduced concentration of hydrogen sulfide; and (e) passing at least a portion of the hydrogen-rich gaseous stream having a reduced concentration of hydrogen sulfide to the high pressure stripper and the first denitrification and desulfurization reaction zone.

In accordance with another embodiment, the present invention relates to an integrated hydrotreating process for the treating of FCC feed to achieve low sulfur specifications in FCC gasoline and the production of an ultra low sulfur diesel stream which process comprises: (a) passing a first hydrocarbonaceous feedstock and hydrogen to a first denitrification and desulfurization reaction zone operated at reaction zone conditions including a temperature from about 204° to 482° C. (400° to 900° F.) and a pressure from about 3.6 to 17.3 MPa (500 to 2500 psig) with a catalyst and recovering a denitrification and desulfurization reaction zone effluent therefrom; (b) passing the denitrification and desulfurization reaction zone effluent to a high pressure stripper maintained at a temperature from about 149° to 454° C. (300° to 850° F.) to produce a first vapor stream and a first liquid stream; (c) passing at least a portion of the first vapor stream and a second feedstock comprising diesel boiling range hydrocarbons to a second denitrification and desulfurization reaction zone to produce a second liquid stream comprising reduced sulfur content, diesel boiling range hydrocarbons and a hydrogen-rich gaseous stream containing hydrogen sulfide; (d) passing the hydrogen-rich gaseous stream containing hydrogen sulfide to an acid gas scrubbing zone to produce a hydrogen-rich gaseous stream having a reduced concentration of hydrogen sulfide; and (e) passing at least a portion of the hydrogen-rich gaseous stream having a reduced concentration of hydrogen sulfide to the high pressure stripper and the first denitrification and desulfurization reaction zone.

Other embodiments of the present invention encompass further details such as types and descriptions of feedstocks, hydrotreating catalysts and preferred operating conditions including temperatures and pressures, all of which are hereinafter disclosed in the following discussion of each of these facets of the invention.

BRIEF DESCRIPTION OF THE DRAWING

The drawing is a simplified process flow diagram of a preferred embodiment of the present invention. The drawing is intended to be schematically illustrative of the present invention and not be a limitation thereof.

DETAILED DESCRIPTION OF THE INVENTION

It has been discovered that a more efficient and economical production of ultra low sulfur diesel stock with high cetane index while treating FCC feed can be achieved and enjoyed in the above-described integrated hydrotreating process.

The process of the present invention is particularly useful for the desulfurization of a gas oil or heavier hydrocarbon stream for subsequent conversion in an FCC unit to produce low sulfur gasoline and the simultaneous production of low sulfur diesel stock.

Previously, when a heavy hydrocarbonaceous feedstock was hydrotreated prior to introduction into a fluid catalytic cracking unit (FCC), the severity of the hydrotreater was selected to permit the FCC to produce gasoline having the required low level sulfur requirement and the sulfur level of co-produced diesel stock in the hydrotreater was not an important consideration. Presently, with the changing requirement of ever-lower sulfur level requirements in diesel fuel, it has become important to provide an economical, integrated hydrotreating process to produce a heavy hydrocarbonaceous product which is suitable for an FCC feedstock as well as a diesel stock having a lowered sulfur concentration.

The process of the present invention is particularly useful for hydrotreating hydrocarbonaceous oil which is subsequently used as a feedstock to an FCC. Illustrative hydrocarbon feedstocks include those containing components boiling above 288° C. (550° F.), such as atmospheric gas oils, vacuum gas oils, deasphalted vacuum and atmospheric residua, mildly cracked residual oils, coker distillates, straight run distillates, solvent-deasphalted oils, pyrolysis-derived oils, high boiling synthetic oils, cycle oils and cat cracker distillates. A preferred hydrotreating feedstock is a gas oil or other hydrocarbon fraction having at least 50% by weight, and most usually at least 75% by weight of its components boiling at temperatures between about 232° and 566° C. (450° and (1050° F.). These hereinabove-described feedstocks are preferably referred to as the first feedstock to the process of the present invention. The second feedstock in accordance with the process of the present invention preferably refers to hydrocarbons boiling in the diesel range. These hydrocarbons preferably boil in the range from about 204° C. to about 343° C. (400° F.–650° F.) and include straight run and cracked diesel boiling range material. Preferably, a majority of the second feedstock boils in the range from about 204° to about 343° C. (400°–650° F.). These hereinabove-described feedstocks are preferably referred to as the first feedstock to the process of the present invention.

The selected first feedstock is first admixed with a hydrogen-rich gaseous stream and introduced into the first denitrification and desulfurization reaction zone at hydrotreating reaction conditions. Preferred denitrification and desulfurization reaction conditions or hydrotreating reaction conditions include a temperature from about 204° to 482° C. (400° to 900° F.) and a liquid hourly space velocity of the hydrocarbonaceous feedstock from about 0.1 $hr^{-1}$ to about 10 $hr^{-1}$ with a hydrotreating catalyst or a combination of hydrotreating catalysts.

The term "hydrotreating" as used herein refers to processes wherein a hydrogen-containing treat gas is used in the presence of suitable catalysts which are primarily active for the removal of heteroatoms, such as sulfur and nitrogen, saturation of olefins and for some hydrogenation of aromatics. Suitable hydrotreating catalysts for use in the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Suitable hydrotreating catalysts may also include a phosphorus component and a preferred FCC pretreat catalyst contains nickel, molybdenum and phosphorus. Other suitable hydrotreating catalysts include zeolitic catalysts, as well as noble metal catalysts where the noble metal is selected from palladium and platinum. It is within the scope of the present invention that more than one type of hydrotreating catalyst be used in the same reaction vessel. The Group VI metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent. Typical hydrotreating temperatures range from about 204° to 482° C. (400° to 900° F.) with pressures from about 3.6 to 17.3 MPa (500 to 2500 psig), preferably from about 3.6 to 13.9 MPa (500 to 2000 psig).

The resulting effluent from the first denitrification and desulfurization reaction zone is introduced into a high pressure stripper, preferably operated at a temperature from about 149° to 454° C. (300° to 850° F.) and a pressure from about 3.6 to 17.3 MPa (500 to 2500 psig) to produce a first vaporous stream containing hydrogen, ammonia, hydrogen sulfide and hydrocarbonaceous compounds, and a first liquid hydrocarbonaceous steam. The first vaporous stream and at least a portion of the second feedstock are introduced into a second denitrification and desulfurization zone. The effluent from the second denitrification and desulfurization zone is partially condensed to produce a hydrogen-rich gaseous stream containing hydrogen sulfide and a second liquid hydrocarbonaceous stream. The resulting hydrogen-rich gaseous stream is preferably passed through an acid gas scrubbing zone, preferably utilizing an aqueous amine scrubbing solution, to reduce the concentration of hydrogen sulfide to produce a purified hydrogen-rich gaseous stream, preferably containing less than about 50 volume ppm hydrogen sulfide, a portion of which may then be recycled to either or both of the denitrification and desulfurization reaction zones, and the high pressure stripper. The first liquid hydrocarbonaceous stream which is preferably a good candidate for a feedstock to an FCC unit is preferably introduced into a hot flash drum to remove dissolved hydrogen and normally gaseous hydrocarbons and subsequently sent to a stripping zone. The second liquid hydrocarbonaceous stream is introduced into the fractionation zone to produce a naphtha stream, a diesel stream and a heavy hydrocarbonaceous stream. The resulting diesel stream contains low levels of sulfur, preferably less than 50 wppm and more preferably less than 10 wppm.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a feed stream containing vacuum gas oil is introduced into the process via line 1 and admixed with a hereinafter described hydrogen-rich gaseous stream transported via line 32 and the resulting admixture is carried via line 2 and introduced into denitrification and desulfurization reaction zone 3. The resulting effluent from denitrification and desulfurization reaction zone 3 is transported via line 4 and introduced into high pressure stripper 5. A hydrogen-rich vapor stream is removed from high pressure stripper 5 via line 15 and is admixed with a diesel boiling range feedstock introduced via lines 12 and 13, and the resulting admixture is carried via line 16 and is admixed with a hydrogen-rich gaseous stream provided via line 31 and the resulting admixture is transported via line 17 and introduced into denitrification and desulfurization reaction zone 18. The resulting effluent from denitrification and desulfurization reaction zone 18 is carried via line 19, passed through heat-exchanger 20, transported via line 21 and introduced into cold vapor-liquid separator 22. A hydrogen-rich gaseous stream containing hydrogen sulfide is removed from cold vapor-liquid separator 22 via line 23 and is introduced into acid gas recovery zone 24. A lean solvent is introduced via line 25 into acid gas recovery zone 24 and contacts the hydrogen-rich gaseous stream in order to dissolve an acid gas. A rich solvent acid gas is removed from acid gas recovery zone 24 via line 26 and recovered. A hydrogen-rich gaseous stream containing a reduced concentration of acid gas is removed from acid gas recovery zone 24 via line 27 and is admixed with fresh makeup hydrogen which is introduced via line 44.

A portion of the secondary fresh feedstock containing diesel boiling range hydrocarbons which is introduced via line 12 is transported via line 14 and is introduced into high pressure stripper 5 to serve as reflux. A liquid hydrocarbonaceous stream containing hydrocarbons boiling above the diesel hydrocarbon boiling range is removed from high pressure stripper 5 via line 6 and introduced into hot flash zone 7. A liquid stream from hot flash zone 7 is transported via line 8 and introduced into stripping zone 9. A vaporous stream and a liquid hydecarbonaceous stream is removed from stripping zone 9 via lines 10 and 11, respectively. A liquid stream containing diesel boiling range hydrocarbons is removed from cold vapor-liquid separator 22 via line 34 and is admixed with a vapor stream from hot flash zone 7 carried via line 33 and the resulting admixture is transported via line 35 and introduced into cold flash zone 36. A gaseous stream containing hydrogen sulfide and normally gaseous hydrocarbons is removed from cold flash zone 36 via line 37 and recovered. A liquid hydrocarbonaceous stream is removed from cold flash zone 36 via line 38 and introduced into fractionation zone 39. A gaseous stream containing normally gaseous hydrocarbons is removed from fractionation zone 39 via line 40 and recovered. A naphtha boiling range stream is removed from fractionation zone 39 via line 41 and recovered. A diesel boiling range hydrocarbon seam is removed from fractionation zone 39 via line 42 and recovered. A liquid hydrocarbonaceous stream containing hydrocarbons boiling above the diesel boiling range is removed from fractionation zone 39 via line 43 and recovered. A portion of the hydrogen-rich gaseous stream carried via line 27 is transported via line 28 and introduced into high pressure stripper 5 to serve as hot stripping gas. Another portion of the hydrogen-rich gaseous stream transported via line 27 is introduced into denitrification and desulfurization reaction zone 18 via lines 30, 31 and 17. Another portion of the hydrogen-rich gaseous stream transported in line 27 is introduced into denitrification and desulfurization reaction zone 3 via lines 30, 32 and 2.

The process of the present invention is further demonstrated by the following illustrative embodiment. This illustrative embodiment is, however, not presented to unduly limit the process of this invention, but to further illustrate the advantage of the hereinabove-described embodiment. The following data were not obtained by the actual performance of the present invention but are considered prospective and reasonably illustrative of the expected performance of the invention.

ILLUSTRATIVE EMBODIMENT

A blended vacuum gas oil (VGO) feedstock in an amount of 3481 $m^3$/day (21900 barrels per day) and having the characteristics presented in Table 1 is admixed with hydrogen and introduced into a first denitrification and desulfurization reaction zone (VGO) to reduce the sulfur and nitrogen concentration of the effluent hydrocarbons. The resulting effluent from the first denitrification and desulfurization reaction zone is introduced into a high pressure stripper at a temperature of 432° C. (809° F.) and a pressure of about 11.8 MPa (1700 psig). A hot hydrogen stripping gas in an amount of 337 $nm^3/m^3$ (2000 standard cubic feet per barrel) based on VGO feed is introduced into a lower portion of the high pressure stripper.

TABLE 1

| VGO Feedstock Analysis | |
|---|---|
| Specific Gravity | 0.9575 |
| Distillation, volume percent | |
| IBP | 243° C. (469° F.) |
| 10 | 343° C. (650° F.) |
| 30 | 374° C. (705° F.) |
| 50 | 393° C. (740° F.) |
| 70 | 422° C. (791° F.) |
| 90 | 472° C. (882° F.) |
| FBP | 534° C. (993° F.) |
| Sulfur, weight percent | 4.15 |
| Nitrogen, wppm | 2700 |

TABLE 2

| Diesel Feedstock Analysis | |
|---|---|
| Specific Gravity | 0.8762 |
| Distillation, volume percent | |
| IBP | 160° C. (320° F.) |
| 10 | 220° C. (428° F.) |
| 30 | 244° C. (472° F.) |
| 50 | 272° C. (522° F.) |
| 70 | 301° C. (574° F.) |
| 90 | 333° C. (632° F.) |
| FBP | 365° C. (689° F.) |
| Sulfur, weight percent | 2.8 |
| Nitrogen, wppm | 800 |

A gaseous phase containing hydrogen, hydrogen sulfide, diesel boiling range hydrocarbons and hydrocarbons boiling below the diesel boiling range is removed from the high pressure stripper and is introduced along with a diesel feedstock in an amount of 4810 $m^3$/day (30,260 barrels per day) and having the characteristics presented in Table 2 into a second denitrification and desulfurization reaction zone. The resulting effluent from the second denitrification and desulfurization reaction zone is cooled to produce hydrogen-rich gaseous stream containing hydrogen sulfide and a liquid hydrocarbonaceous stream containing naphtha and 4649 $m^3$/day (29245 barrels per day) of diesel boiling range hydrocarbons having a sulfur concentration of less than 10 wppm. The hydrogen-rich gaseous stream containing hydrogen sulfide is scrubbed to reduce the hydrogen sulfide concentration to less than 50 volume ppm.

A liquid hydrocarbonaceous stream having hydrocarbons boiling at a temperature greater than 343° C. (650° F.) in an amount of 3752 $m^3$/day (23600 barrels per day) and having a sulfur concentration of 1000 wppm is removed from the high pressure stripper and recovered as a suitable FCC feed.

The integrated process of the present invention allows the second denitrification and desulfurization reaction zone to operate at the same pressure level as that of the first denitrification and desulfurization reaction zone as well as using excess hydrogen from the first reaction zone thereby permitting the production of a diesel product having ultra low sulfur concentrations and high cetane index. The present invention achieves lower capital and operating costs due to the shared or eliminated equipment costs.

The foregoing description, drawing and illustrative embodiment clearly illustrate the advantages encompassed by the process of the present invention and the benefits to be afforded with the use thereof.

What is claimed is:

1. An integrated hydrotreating process for the treating of FCC feed to achieve low sulfur specifications in FCC gasoline and the production of an ultra low sulfur diesel stream which process comprises:

a) passing a first hydrocarbonaceous feedstock and hydrogen to a first denitrification and desulfurization reaction zone operated at reaction zone conditions including a temperature from about 204° to 482° C. (400° to 900° F.) and a pressure from about 3.6 to 17.3 MPa (500 to 2500 psig) with a catalyst and recovering a denitrification and desulfurization reaction zone effluent therefrom;

b) passing the denitrification and desulfurization reaction zone effluent to a high pressure stripper maintained at a temperature from about 149° to 454° C. (300° to 850° F.) to produce a first vapor stream and a first liquid stream;

c) passing at least a portion of the first vapor stream and a second feedstock comprising diesel boiling range hydrocarbons to a second denitrification and desulfurization reaction zone to produce a second liquid stream comprising reduced sulfur content, diesel boiling range hydrocarbons and a hydrogen-rich gaseous stream containing hydrogen sulfide; and d) passing the hydrogen-rich gaseous stream containing hydrogen sulfide to an acid gas scrubbing zone to produce a hydrogen-rich gaseous stream having a reduced concentration of hydrogen sulfide; and e) passing at least a portion of the hydrogen-rich gaseous stream having a reduced concentration of hydrogen sulfide to the high pressure stripper and the first denitrification and desulfurization reaction zone.

2. The process of claim 1 wherein at least a portion of the first liquid stream is passed to at least one vapor-liquid separator to produce a third liquid stream containing reduced sulfur content and hydrocarbons boiling above the diesel boiling range.

3. The process of claim 1 wherein the second denitrification and desulfurization reaction zone is operated at reaction zone conditions including a temperature from about 204° to 482° C. (400° to 900° F.) and a pressure from about 3.6 to 17.3 MPa (500 to 2500 psig).

4. The process of claim 1 wherein a majority of the first hydrocarbonaceous feedstock boils in the range from about 232° to 566° C. (450° to 1050° F.).

5. The process of claim 1 wherein a majority of the second hydrocarbonaceous feedstock boils in the range from about 204° C. to about 343° C. (400° F.–650° F.).

6. The process of claim 1 wherein the hydrogen introduced into the high pressure stripper contains less than about 50 volume ppm hydrogen sulfide.

7. The process of claim 1 wherein the second liquid stream comprising reduced sulfur content, diesel boiling range hydrocarbons contains less than about 50 wppm sulfur.

8. The process of claim 2 wherein the third liquid stream containing reduced sulfur content and hydrocarbons boiling above the diesel range is suitable for a feedstock to a fluid catalytic cracking unit.

9. The process of claim 1 wherein the acid gas scrubbing zone utilizes an aqueous amine scrubbing solution.

10. An integrated hydrotreating process for the production of a low sulfur diesel stream which process comprises:

a) passing a first hydrocarbonaceous feedstock and hydrogen to a first denitrification and desulfurization reaction zone operated at reaction zone conditions including a temperature from about 204° to 482° C. (400° to 900° F.) and a pressure from about 3.6 to 17.3 MPa (500 to 2500 psig) with a catalyst and recovering a denitrification and desulfurization reaction zone effluent therefrom;

b) passing the denitrification and desulfurization reaction zone effluent to a high pressure stripper maintained at a temperature from about 149° to 454° C. (300° to 850° F.) to produce a first vapor stream and a first liquid seam;

c) passing at least a portion of the first vapor stream and a second feedstock comprising diesel boiling range hydrocarbons to a second denitrification and desulfurization reaction zone to produce a second liquid stream comprising reduced sulfur content, diesel boiling range hydrocarbons and a hydrogen-rich gaseous stream containing hydrogen sulfide;

d) passing the hydrogen-rich gaseous stream containing hydrogen sulfide to an acid gas scrubbing zone to produce a hydrogen-rich gaseous stream having a reduced concentration of hydrogen sulfide; and e) passing at least a portion of the hydrogen-rich gaseous stream having a reduced concentration of hydrogen sulfide to the high pressure stripper and the first denitrification and desulfurization reaction zone.

* * * * *

UNITED STATES PATENT AND TRADEMARK OFFICE

CERTIFICATE OF CORRECTION

PATENT NO. : 6,793,804 B1 
DATED : September 21, 2004
INVENTOR(S) : David A. Lindsay, Gary R. Brierley and Tom N. Kalnes It is certified that error appears in the above-identified patent and that said Letters Patent is hereby corrected as shown below:

Column 9,
Line 8, "seam" should be replaced with -- stream. --

Signed and Sealed this

Twenty-fifth Day of January, 2005

JON W. DUDAS
*Director of the United States Patent and Trademark Office*